US009254045B2

(12) United States Patent
Nassif

(10) Patent No.: US 9,254,045 B2
(45) Date of Patent: Feb. 9, 2016

(54) TRANSFORMABLE FURNITURE UNIT

(71) Applicant: Charbel Nassif, Saint Eustache (CA)

(72) Inventor: Charbel Nassif, Saint Eustache (CA)

( * ) Notice: Subject to any disclaimer, the term of this patent is extended or adjusted under 35 U.S.C. 154(b) by 0 days.

(21) Appl. No.: 14/256,287

(22) Filed: Apr. 18, 2014

(65) Prior Publication Data

US 2014/0310871 A1 Oct. 23, 2014

Related U.S. Application Data

(60) Provisional application No. 61/813,758, filed on Apr. 19, 2013.

(51) Int. Cl.

| | |
|---|---|
| ***A47D 11/00*** | (2006.01) |
| ***A47C 17/14*** | (2006.01) |
| ***A47D 5/00*** | (2006.01) |
| ***A47C 11/00*** | (2006.01) |
| ***A47C 13/00*** | (2006.01) |

(52) U.S. Cl.

CPC ..... *A47C 17/14* (2013.01); *A47C 11/00* (2013.01); *A47C 13/00* (2013.01); *A47D 5/00* (2013.01); *A47D 11/00* (2013.01)

(58) Field of Classification Search

CPC ..... A47D 11/00

USPC ..... 5/2.1, 3, 93.2, 8, 9.1

See application file for complete search history.

(56) References Cited

U.S. PATENT DOCUMENTS

| | | | | |
|---|---|---|---|---|
| 5,297,305 | A * | 3/1994 | Williams | 5/655 |
| 2004/0216228 | A1* | 11/2004 | Briere | 5/93.2 |

* cited by examiner

*Primary Examiner* — Fredrick Conley

(74) *Attorney, Agent, or Firm* — Loza & Loza, LLP; Razmig Messerian

(57) ABSTRACT

This invention relates to a transformable furniture unit, and in particular to a changing table with shelving that transforms into two sitting benches, and into a bed. The infant's changing table with shelving comprises four posts that support two tiers of shelving, with the capacity to support additional tiers in another aspect of the invention. The tiers of shelving are supported by wooden beams that connect perpendicularly to the four posts. The changing table with shelving transforms into two sitting benches when one tier of shelving is detached from the other. The furniture can be transformed into a bed when the sitting bench with the high back support is used as a headboard, the second sitting bench with no back support is used as the foot of the bed, and a supplementary support panel is attached in between, holding together the headboard and the foot of the bed.

20 Claims, 4 Drawing Sheets

TRANSFORMABLE FURNITURE UNIT

CLAIM OF PRIORITY

The present application for patent claims priority to U.S. Provisional Application No. 61/813,758 entitled "Transformable Furniture Unit" filed Apr. 19, 2013, the entire disclosure of which is hereby expressly incorporated by reference herein.

BACKGROUND

1. Field

The present invention relates to a transformable furniture unit, and more particularly, to transformable furniture into multiple bedroom furniture.

2. Background

In preparing a home for the arrival of a new child, parents and caregivers naturally desire to provide all the objects that a child may need for his survival and comfort. Among these objects are pieces of furniture that allow a child to sleep, sit, eat, or play, or bathe, among other things.

Parents and caregivers also desire to provide to themselves objects that make caring for a child an easier process. For this reason, parents and caregivers purchase objects like changing tables, which allow a child to be placed on a flat surface, the height of which is ideal and comfortable for the parent or caregiver who is changing the child's diaper. Because changing a child's diaper occurs multiple, and often countless times per day, pieces of furniture like a changing table are key in maintaining the comfort and speed with which a parent or caregiver changes a child's diaper. Furthermore, changing tables are not only high, flat surfaces upon which to place a child. They also provide storage for diapers, baby wipes, and other things that a parent or caregiver needs at the time he or she is changing a diaper.

Storage on a changing table is not only for the purpose of the convenience of the parent or caregiver; storage on a changing table may often times contribute to the safety of the child being changed. Storage on a changing table serves to provide the parent or caregiver with all the supplies he or she needs to complete the changing of the diaper, without his or her needing to step away from the child to retrieve an item that they need but is not within reach. Leaving a child unattended on a changing table, or any high surface, is very dangerous. The child may fall and suffer an injury. For this reason, storage on a changing table also serves to provide a safe environment within which to care for the child, and more particularly, a safer environment within which to change the child's diaper.

While a parent or caregiver desires to provide their child and themselves with objects that they or the child may need or desire for comfort, he or she may simultaneously be concerned about the cost of the object or the floor space that the object consumes in a home. Along the same lines, a parent or caregiver is concerned about the use or lack thereof of the changing table once there is no longer any need to change the child's diaper. In other words, a budget-conscious parent or caregiver desires that any object they purchase for their child or themselves is a good value. As with most children's furniture, changing tables are often discarded or rendered useless when a child reaches an age in which his or her diaper is no longer necessary.

Environmentally-conscious parents and caregivers who desire to benefit the natural environment will find a continued use for the changing table once its initial use is gone. For this reason, those parents and caregivers can rest assured knowing that an old and unused changing table is not discarded. Rather, it is put into new uses as two sitting benches or as a bed. In the industry today, the designs for changing tables do not vary by much. At their most basic, the designs for changing tables include merely a flat surface that is supported by open shelving. More elaborate designs in the industry include a flat surface that is supported by drawers. Such designs allow a changing table to be continued to be used as a storage dresser once the need to change the child's diaper is gone. However, the industry lacks a design that may function as more than just a storage dresser with drawers after its use as a changing table is no longer needed. Hence, in light of the aforementioned, there is a need for an improved design which, by virtue of its design and components, would be able to overcome or at least minimize some of the aforementioned problems with prior art. The industry needs a design by which a changing table can be converted into two sitting benches and into a bed.

SUMMARY

The object of the present invention is to provide a design of a changing table that may be converted into two sitting benches and into a bed so as to maximize the value of a parent or caregiver's monetary investment in a changing table and minimize the negative effects on the natural environment when there is no longer a need to change a child's diaper. By virtue of its design and components, this model and method satisfies the above-mentioned needs and is thus an improvement over other related designs known in the prior art.

In accordance with the present invention, the above object, and other objects and advantages are achieved, as will be easily understood, with a transformable furniture unit that is used initially as an infant's changing table with shelving. The infant's table with shelving meets the object by having the capacity to be transformed into two sitting benches, and also into a bed. This is described briefly herein and is exemplified in the accompanied drawings.

In one aspect of the present invention, a transformable furniture unit comprises a first component with a headboard. The transformable furniture unit also comprises a second component removably secured to the first component and securing means interconnecting the first and second components in a first position.

In another aspect of the present invention, a transformable furniture unit comprises a first component with a headboard. The transformable furniture units also comprises a middle member secured to the first component, a second component secured to the middle member and securing means interconnecting the middle member to the first and second components in a second position.

Preferably, the size and shape of the third support surface, when attached to the middle of the two sitting benches in order to form a bed, are such that the bed is of standard twin size in order to accommodate a standard twin size mattress on the market.

Preferably, the frame of the item of transformable furniture contains decorative slats or spindles of varying shapes and sizes. These decorative slats or spindles are not necessary to the structural integrity or function of the item of transformable furniture.

The objects, advantages, and other features of the present invention will become more apparent upon the reading of the following non-restrictive description of preferred embodiments thereof, given for purposes of exemplification only, with reference to the accompanying drawings.

DETAILED DESCRIPTION

Figure 1:
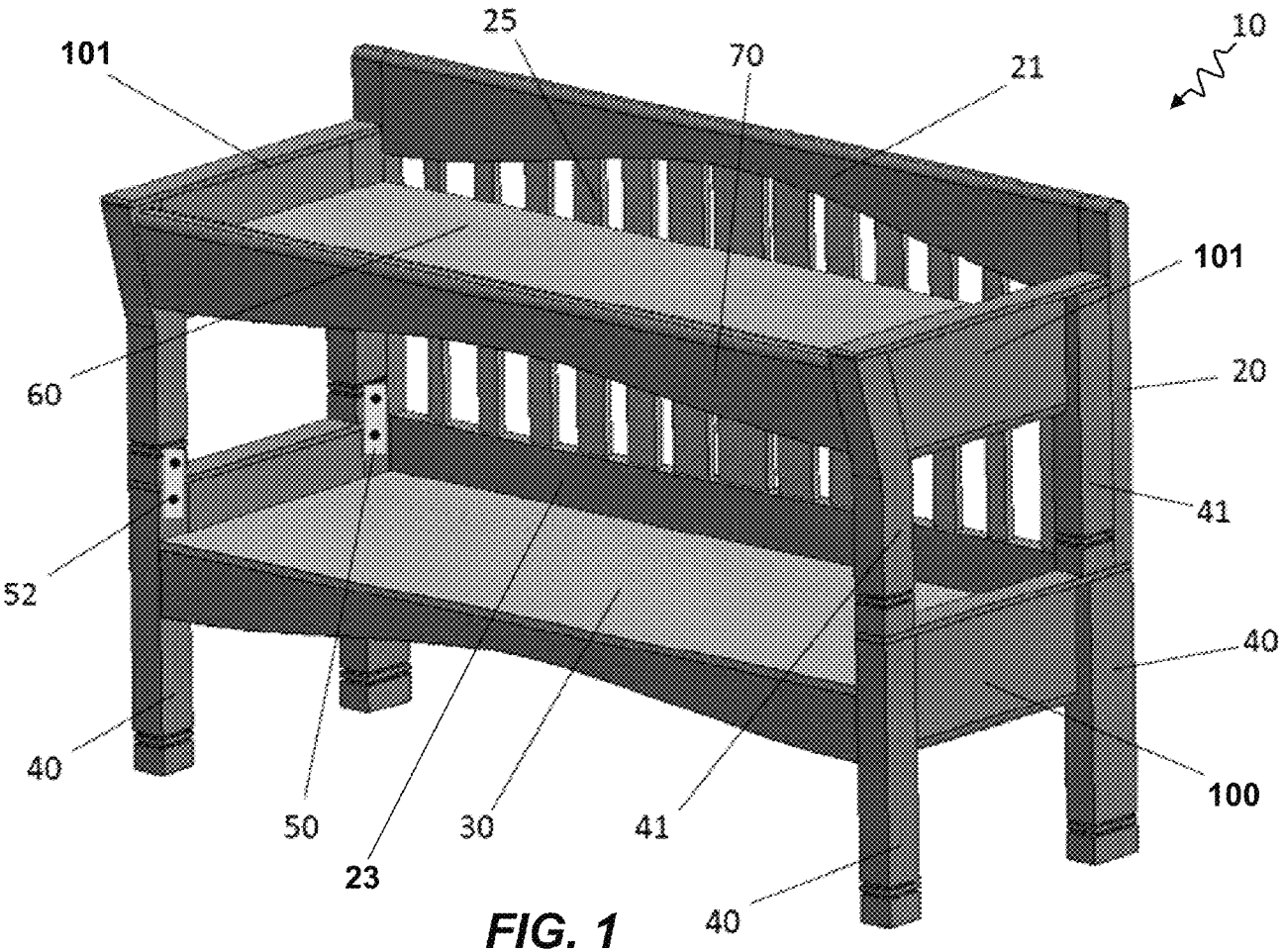
FIG. 1 is a top perspective view of the item of transformable furniture set up in a first position as a changing table with shelving.

In the following description, the same numerical references refer to similar elements. Furthermore, for sake of simplicity and clarity, namely so as not to burden unduly the figures with several reference numbers, only some of the figures have been provided with reference numbers, and components and feature of the present invention illustrated in other figures can be easily inferred therefrom. The embodiments, geometric configurations, materials mentioned and/or dimensions shown in the figures are preferred for exemplification purposes only.

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Moreover, although the present item of transformable furniture was primarily designed for use in a child's room, or for the initial use of changing a child's diaper, it is understood that it may be used instead as a mere shelving unit as apparent to a person skilled in the art. For this reason, expressions such as "child", "infant", "parent", "caregiver", "changing table", etc. as used herein should not be taken as to limit the scope of the present invention and includes all other kinds of items, objects and/or purposes with which the present invention could be used and may be useful.

Moreover, in the context of the present invention, the expressions "infant" and "child" can be used interchangeably.

Moreover, in the context of the present invention, the expressions "parent" and "caregiver" can be used interchangeably.

Moreover, in the context of the present invention, the expressions "shelf", "shelves", "support surface" and "shelving" can be used interchangeably.

Moreover, in the context of the present invention, the expression "sitting" and "seating" can be used interchangeably.

Moreover, in the context of the present invention, the expression "nail" and "screw" can be used interchangeably.

In addition, although the preferred embodiment of the present invention as illustrated in the accompanying drawings comprises various components and although the preferred embodiment of the support as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the relevant art, that other suitable components and cooperations thereinbetween, as well as other suitable geometrical configurations may be used for the device, and the corresponding parts, according to the present invention, as briefly explained and as can be easily inferred here from by a person skilled in the art, without departing from the scope of the invention.

Broadly described, the item of transformable furniture according to the present invention and as shown in the accompanying drawings, is an invention which, in its preferred intended use, allows for one item of furniture to be used in at least three different ways: as a changing table with shelving, as two sitting benches, and as a bed.

A typical use of the item transformable furniture is by a parent or childcare provider who desires to purchase furniture that will have multiple uses, serves as environmentally friendly, or green, and is budget friendly.

Because of its multiple uses, the item of transformable furniture is utilized over a longer period of time than non-transformable furniture. This longer period of utilization of the furniture is budget friendly, as a parent or childcare provider does not have to purchase additional furniture. This longer period of use also prevents excess waste; the furniture is not discarded when it is no longer being used. This longer period functions as an environmentally friendly alternative to purchasing more pieces of furniture as their functions become needed.

This item of transformable furniture is constructed such that it serves as a changing table with shelving. When the tiers of the changing table are pulled apart from each other, or stated differently, when the top tier is removed from the bottom tier, the two tiers become two sitting benches. In its third form, a third rectangular piece is inserted parallel to and in between the two sitting benches, thus becoming a bed.

For example, the transformable furniture unit may be a changing table with shelving that transforms into two sitting benches, and into a bed. The infant's changing table with shelving comprises four posts that support two tiers of shelving, with the capacity to support additional tiers in another aspect of the invention. The tiers of shelving are supported by wooden beams that connect perpendicularly to the four posts. The changing table with shelving transforms into two sitting benches when one tier of shelving is detached from the other. Each of the two tiers of shelving is transformed into a single sitting bench, resulting in two sitting benches. The furniture can be transformed into a bed when the sitting bench with the high back support is used as a headboard, the second sitting bench with no back support is used as the foot of the bed, and a supplementary support panel is attached in between, holding together the headboard and the foot of the bed. When transformed into a bed, the furniture unit comprises a headboard and a bed frame that embodies dimensions that may measure to fit any one standard-sized mattress on the market today, whether twin, full, queen, or king Since the bed transforms from what was used as an infant's changing table, in its preferred use, its measurements as converted fit a twin-sized mattress.

More specifically, and with reference to FIG. 1, the transformable furniture unit 10 is shown in a first position set up as a changing table with shelving, and is comprised at least of a horizontal top beam 21 and legs 20, positioned behind second support surface 60 and first support surface 30. The first and second support surfaces 30, 60 are positioned one atop the other by means of upper support legs 41. Second support surface 60 is surrounded on three sides by upper bordering beams 70 and 101, and is supported by upper support legs 41. First support surface 30 is surrounded on three sides by lower bordering beams 100 and 23, and is supported by lower support legs 40. Upper support legs 41 are affixed to lower support legs 40 by means of connectors 50, located at every intersection between said upper and lower support legs 41, 40. Connectors 50 are affixed to upper support legs 41 and lower support legs 40 by means of screws 52 which are screwed into holes (not shown).

Figure 2A:
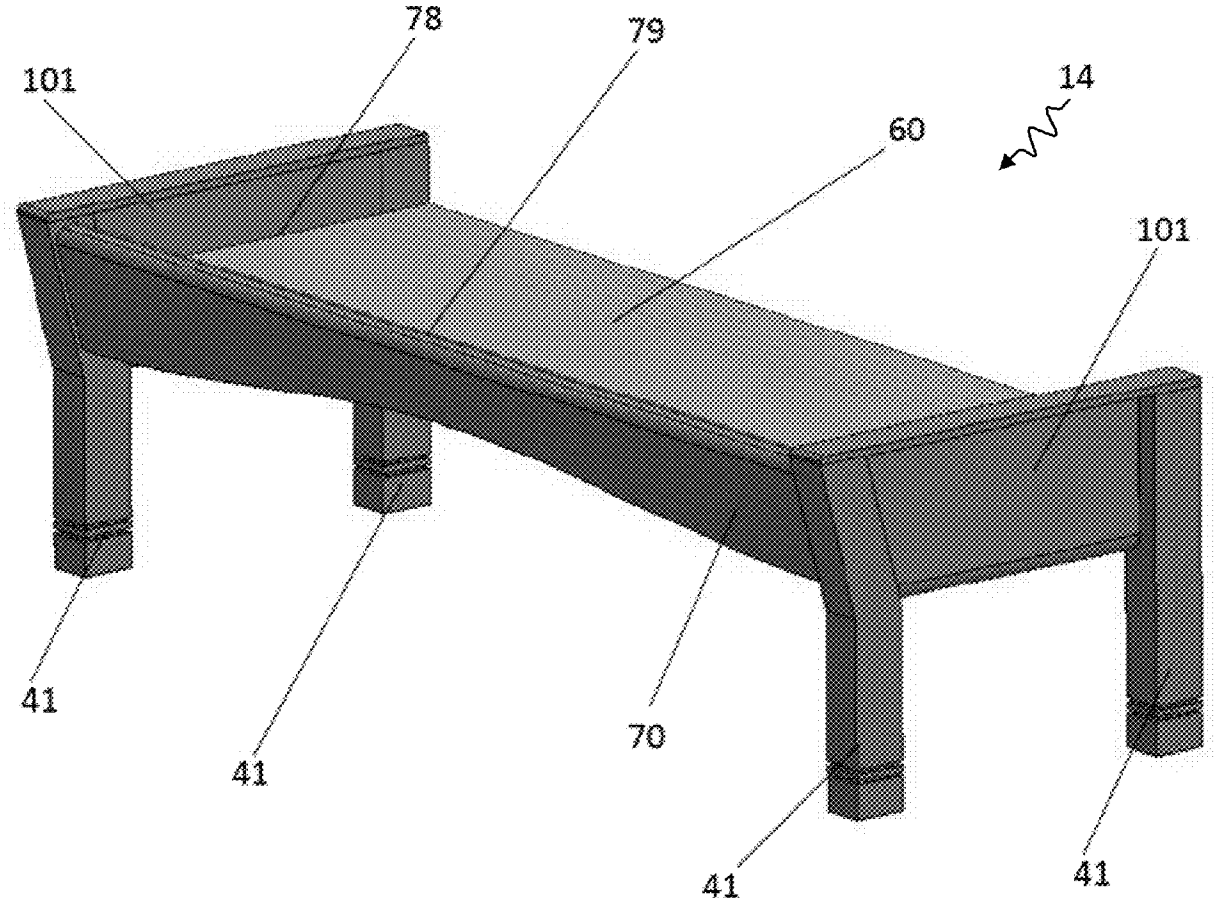
FIG. 2*a* is a top perspective view of first component of the item of transformable furniture set up as a sitting bench.
Figure 2B:
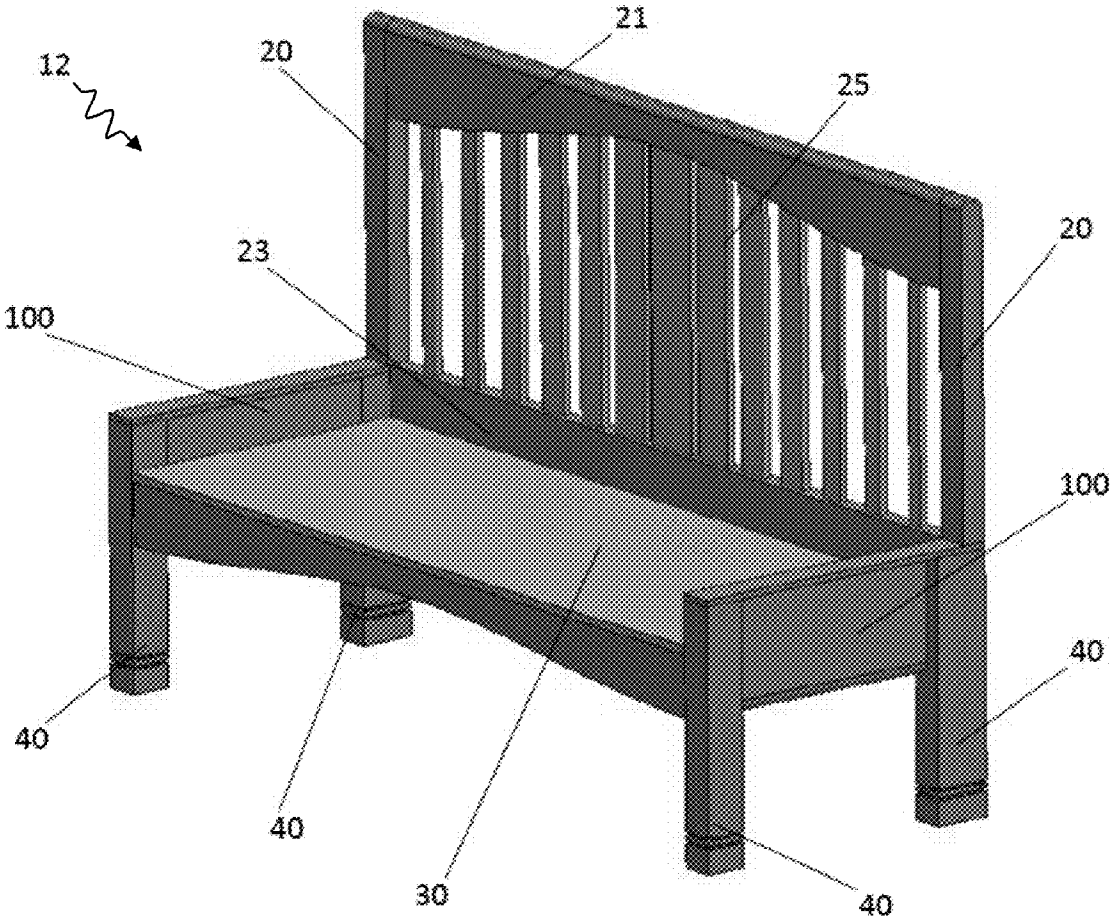
FIG. 2*b* is a top perspective view of second component of the item of transformable furniture set up as a sitting bench.

Further, and in reference to FIGS. 2*a* and 2*b*, the transformable furniture unit 10 that was shown in FIG. 1 has been disassembled into a first and second component 12, 14 as two sitting benches. It is apparent from FIGS. 2*a* and 2*b* that the first component 12 is removably connected to the second component 14 by means of securing means as detailed above. The second component 14 which can be characterized as a sitting bench, is created when the second support surface 60 with its upper bordering beams 70, 101, and support legs 41 are removed from atop the first support surface 30 of the first component 12 which can also now be characterized as a sitting bench with a back rest. The detachment of the transformable furniture unit 10 is achieved by removing the second component 14 from the first component 12 by unscrewing the screws (not shown) from the securing means (not shown), thereby creating two separate pieces of furniture which have been characterized as first and second components 12, 14. In this embodiment, the securing means is comprised of a strong, metallic connecting member with two holes and screws or bolts or nails that links two adjacent components; however, a worker skilled in the art would appreciate that the securing means could be comprised of other types without departing from the scope of the invention. For example, the connecting member be could of different sizes and could have a multitude of holes for the insertion of nails, screws or bolts.

With further reference to FIGS. 2*a* and 2*b*, second component 14 is comprised of second support surface 60, upper bordering beams 101, 70, and upper support legs 41. Meanwhile, the first component 12 comprises horizontal top beam 21 and vertical legs 20. First component 12 is further comprised of slats 25 that function as decorative elements but are not necessary to the construction of the item of transformable furniture 10. The combination of the slats 25, legs 20 and horizontal top beam 21 make up a headboard of the first component 12, as they are positioned perpendicularly to the first support surface 30, nearest to lower bordering beam 23. First support surface 30 is supported by lower support legs 40, and flanked by means of lower bordering beams 100 which are perpendicular to lower bordering beam 23. The lower bordering beams 23, 100 protrude slightly above the horizontal plane of first support surface 30, thereby creating support for padding if a user wishes to place padding atop first support surface 30. Meanwhile, second support surface 60 is flanked on a narrow side 78 by upper bordering beams 101 and on a wide side 79 by an upper bordering beam 70. These upper bordering beams 70 and 101 protrude slightly above the horizontal plane of second support surface 60, thereby creating support for padding if a user wishes to place padding atop second support surface 60.

Figure 3:
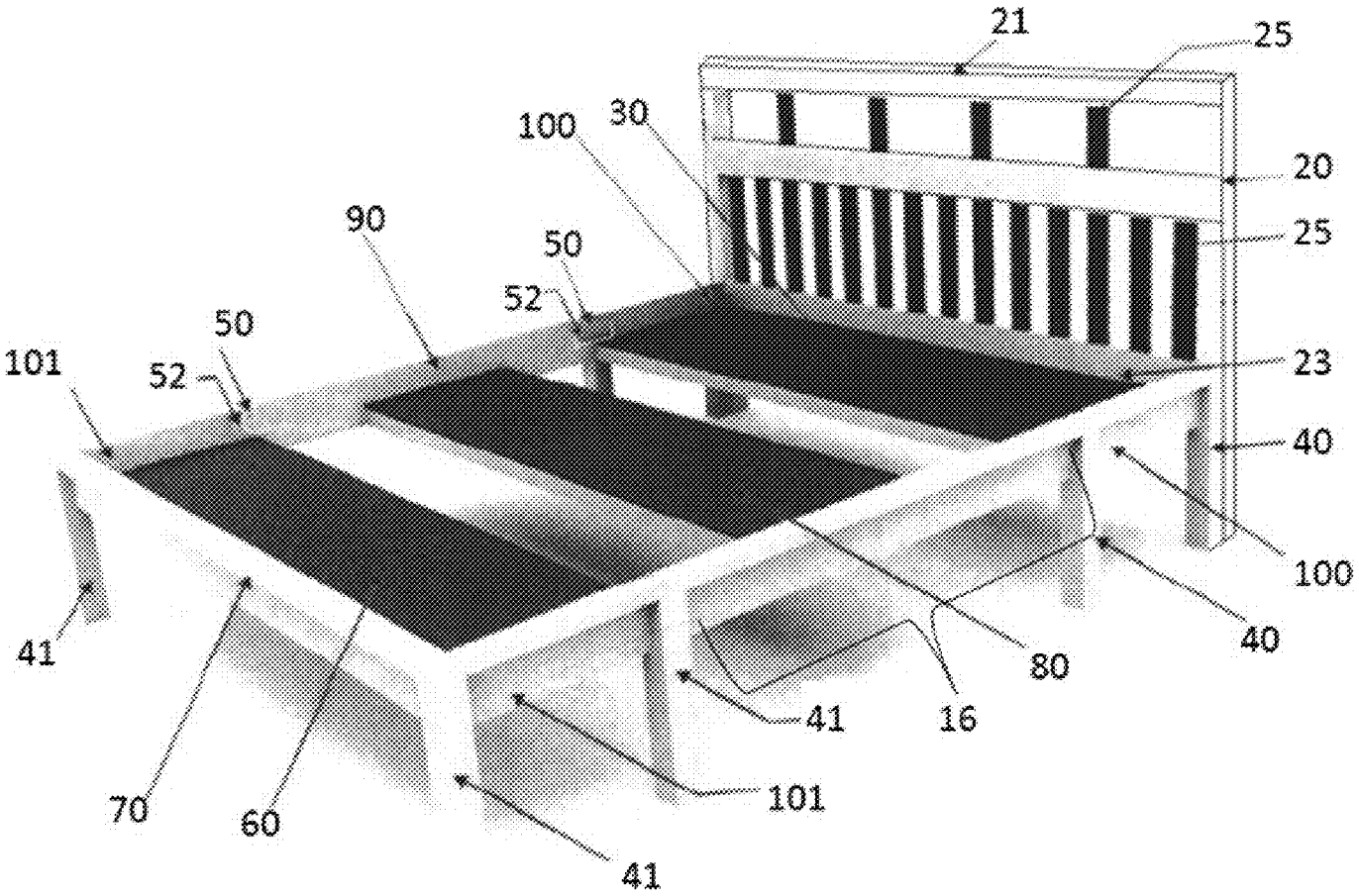
FIG. 3 is a top perspective view of the item of transformable furniture set up in a second position as a bed.

With reference to FIG. 3, the transformable furniture unit 10 has been disassembled into first and second components 12, 14 and middle member 16 and has been set up as a bed in a second position, with slats 25, legs 20 and horizontal top beam 21 acting as the headboard. The middle member 16 is comprised of third support surface 80 and two connecting beams 90. In order to construct the bed, the first and second support surfaces 30, 60 are positioned parallel on a horizontal plane to the third support surface 80. The upper support legs 41 of the second component 14 and lower support legs 40 of the first component 12 act as a support means, and a securing means 50 is affixed between both upper and lower bordering beams 101, 100 and matching connecting beams 90.

A worker skilled in the relevant art would be familiar with the use of other components for the middle member as well as to the use of different size support surfaces while being within the scope of the present invention.

What is claimed is:

1. A transformable furniture unit comprising:

a first component including a headboard, a plurality of lower support legs, and a first support surface, the first support surface coupled to the headboard at a substantially perpendicular angle, each of the plurality of lower support legs having a top portion and a bottom portion, the top portion of each of the plurality of lower support legs coupled to the first support surface; and a second component adapted to removably couple to the first component via connectors, the second component including a second support surface and a plurality of upper support legs, each of the plurality of upper support legs having a top portion and a bottom portion, the top portion of each of the plurality of upper support legs coupled to the second support surface;

wherein the first component is adapted to detach from the second component to change the transformable furniture unit into a pair of separate benches, and one of the pair of benches includes a backrest comprising the headboard.

2. The transformable furniture unit of claim 1, wherein the headboard is further comprised of a plurality of slats, two horizontal legs and a horizontal top beam.

3. The transformable furniture unit of claim 1, wherein the bottom portion of each of the upper support legs is adapted to removably couple via the connectors to the top portions of the plurality of lower support legs to place the transformable furniture unit into a baby changing table state.

4. The transformable furniture unit of claim 1, wherein the first component includes lower bordering beams that surround three sides of the first support surface, the lower bordering beams including a first lower bordering beam coupled to the headboard.

5. The transformable furniture unit of claim 4, wherein the lower bordering beams protrude above a horizontal plane of the first support surface.

6. The transformable furniture unit of claim 1, wherein the second component includes upper bordering beams that surround three sides of the second support surface.

7. The transformable furniture unit of claim 6, wherein the upper bordering beams protrude above a horizontal plane of the second support surface.

8. The transformable furniture unit of claim 1, further comprising:

a middle member having two connecting beams and a third support surface, the middle member adapted to couple at a first end to the first component and a second, opposite end to the second component to place the transformable furniture unit into a bed state, the first, second, and third support surfaces all being substantially within a same horizontal plane.

9. The transformable furniture unit of claim 8, wherein the first component includes lower bordering beams that surround three sides of the first support surface leaving a fourth side of the first support surface open, the second component includes upper bordering beams that surround three sides of the second support surface leaving a fourth side of the second support surface open, and the first end of the middle member is adapted to couple to the fourth side of the first support surface and the second end of the middle member is adapted to couple to the fourth side of the second support surface.

10. The transformable furniture unit of claim 9, wherein the lower bordering beams, the upper bordering beams, and the two connecting beams protrude above the horizontal plane of the first, second, and third support surfaces.

11. A transformable furniture unit comprising:

a first component including a headboard, a plurality of lower support legs, and a first support surface, the first support surface coupled to the headboard at a substantially perpendicular angle, each of the plurality of lower support legs having a top portion and a bottom portion, the top portion of each of the plurality of lower support legs coupled to the first support surface;

a second component adapted to removably couple to the first component via connectors, the second component including a second support surface and a plurality of upper support legs, each of the plurality of upper support legs having a top portion and a bottom portion, the top portion of each of the plurality of upper support legs coupled to the second support surface, the first component adapted to detach from the second component to change the transformable furniture unit into a pair of separate benches, and one of the pair of benches includes a backrest comprising the headboard; and, a middle member having two connecting beams and a third support surface, the middle member adapted to couple at a first end to the first component and a second, opposite end to the second component to place the transformable furniture unit into a bed state, the first, second, and third support surfaces all being substantially within a same horizontal plane.

12. The transformable furniture unit of claim 11, wherein the first component includes lower bordering beams that surround three sides of the first support surface leaving a fourth side of the first support surface open, the second component includes upper bordering beams that surround three sides of the second support surface leaving a fourth side of the second support surface open, and the first end of the middle member is adapted to couple to the fourth side of the first support surface and the second end of the middle member is adapted to couple to the fourth side of the second support surface.

13. The transformable furniture unit of claim 12, wherein the lower bordering beams, the upper bordering beams, and the two connecting beams protrude above the horizontal plane of the first, second, and third support surfaces.

14. A transformable furniture unit comprising:

a first component including a headboard, a plurality of lower support legs, and a first support surface, the first support surface coupled to the headboard at a substantially perpendicular angle, each of the plurality of lower support legs having a top portion and a bottom portion, the top portion of each of the plurality of lower support legs coupled to the first support surface; and a second component adapted to removeably couple to the first component via a means for securing, the second component including a second support surface and a plurality of upper support legs, each of the plurality of upper support legs having a top portion and a bottom portion, the top portion of each of the plurality of upper support legs coupled to the second support surface;

wherein the first component is adapted to detach from the second component to change the transformable furniture unit into a pair of separate benches, and one of the pair of benches includes a backrest comprising the headboard.

15. The transformable furniture unit of claim 14, wherein the bottom portion of each of the upper support legs is adapted to removeably couple via the means for securing to the top portions of the plurality of lower support legs to place the transformable furniture unit into a baby changing table state.

16. The transformable furniture unit of claim 14, wherein the first component includes lower bordering beams that surround three sides of the first support surface, the lower bordering beams including a first lower bordering beam coupled to the headboard, and the lower bordering beams protruding above a horizontal plane of the first support surface.

17. The transformable furniture unit of claim 14, wherein the second component includes upper bordering beams that surround three sides of the second support surface, the upper bordering beams protruding above a horizontal plane of the second support surface.

18. The transformable furniture unit of claim 14, further comprising:

a middle member having two connecting beams and a third support surface, the middle member adapted to couple at a first end to the first component and a second, opposite end to the second component to place the transformable furniture unit into a bed state, the first, second, and third support surfaces all being substantially within a same horizontal plane.

19. The transformable furniture unit of claim 18, wherein the first component includes lower bordering beams that surround three sides of the first support surface leaving a fourth side of the first support surface open, the second component includes upper bordering beams that surround three sides of the second support surface leaving a fourth side of the second support surface open, and the first end of the middle member is adapted to couple to the fourth side of the first support surface and the second end of the middle member is adapted to couple to the fourth side of the second support surface.

20. The transformable furniture unit of claim 19, wherein the lower bordering beams, the upper bordering beams, and the two connecting beams protrude above the horizontal plane of the first, second, and third support surfaces.

* * * * *